US010174558B2

(12) United States Patent
Hess

(10) Patent No.: US 10,174,558 B2
(45) Date of Patent: Jan. 8, 2019

(54) DOWNHOLE COMMUNICATION BETWEEN WELLBORES UTILIZING SWELLABLE MATERIALS

(71) Applicant: Halliburton Energy Services, Inc., Houston, TX (US)

(72) Inventor: Joseph E. Hess, Richmond, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 223 days.

(21) Appl. No.: 15/023,775

(22) PCT Filed: Oct. 28, 2013

(86) PCT No.: PCT/US2013/067133
§ 371 (c)(1),
(2) Date: Mar. 22, 2016

(87) PCT Pub. No.: WO2015/065321
PCT Pub. Date: May 7, 2015

(65) Prior Publication Data

US 2016/0230464 A1 Aug. 11, 2016

(51) Int. Cl.
*E21B 7/06* (2006.01)
*E21B 29/06* (2006.01)

(52) U.S. Cl.
CPC ..... *E21B 7/06* (2013.01); *E21B 29/06* (2013.01)

(58) Field of Classification Search
None
See application file for complete search history.

(56) References Cited

U.S. PATENT DOCUMENTS 3,385,367 A 5/1968 Kollsman
4,044,830 A 8/1977 Van Huisen
5,230,387 A 7/1993 Waters et al.
(Continued)

FOREIGN PATENT DOCUMENTS

WO WO-2015065321 A1 5/2015

OTHER PUBLICATIONS

"Saudi Arabian Application Serial No. 516370778, Office Action dated Apr. 27, 2016", (w/ Partial English Translation), 3 pgs.
(Continued)

*Primary Examiner* — Shane Bomar
(74) *Attorney, Agent, or Firm* — Chamberlain Hrdlicka

(57) ABSTRACT

A method of connecting to an existing wellbore downhole can include installing a swellable material into the existing wellbore from a connecting wellbore drilled into the existing wellbore. A well system can include a relief wellbore drilled proximate an existing wellbore, a connecting wellbore drilled from the relief wellbore to the existing wellbore, a tubular string extending from the relief wellbore through the connecting wellbore and into the existing wellbore, and a swellable material which swells in an annulus formed between the tubular string and at least one of the relief wellbore, the connecting wellbore and the existing wellbore. Another method of connecting to an existing wellbore downhole can include drilling a relief wellbore proximate the existing wellbore, then drilling a connecting wellbore from the relief wellbore to the existing wellbore, and then installing a swellable material into the existing wellbore from the connecting wellbore.

20 Claims, 5 Drawing Sheets

(56) References Cited

U.S. PATENT DOCUMENTS

| | | | | |
|---|---|---|---|---|
| 5,655,605 | A | 8/1997 | Matthews | |
| 6,026,913 | A * | 2/2000 | Mandal | E21B 47/02208 175/45 |
| 6,119,776 | A * | 9/2000 | Graham | E21B 43/17 166/245 |
| 6,199,633 | B1 | 3/2001 | Longbottom | |
| 6,279,658 | B1 * | 8/2001 | Donovan | E21B 17/00 166/250.15 |
| 6,431,282 | B1 | 8/2002 | Bosma et al. | |
| 7,059,415 | B2 | 6/2006 | Bosma et al. | |
| 7,143,832 | B2 | 12/2006 | Freyer | |
| 9,145,767 | B2 * | 9/2015 | Borges | E21B 7/04 |
| 9,388,668 | B2 * | 7/2016 | McAnally | E21B 43/01 |
| 2004/0261990 | A1 | 12/2004 | Bosma et al. | |
| 2006/0266531 | A1 | 11/2006 | Hepburn et al. | |
| 2007/0108201 | A1 * | 5/2007 | Vinegar | C10L 3/08 219/770 |
| 2007/0257405 | A1 | 11/2007 | Freyer | |
| 2008/0236808 | A1 | 10/2008 | Best et al. | |
| 2010/0071905 | A1 * | 3/2010 | Renshaw | E21B 33/1208 166/313 |
| 2012/0205159 | A1 * | 8/2012 | Borges | E21B 43/305 175/61 |
| 2013/0037272 | A1 | 2/2013 | Dale et al. | |
| 2016/0326818 | A1 * | 11/2016 | Lajesic | E21B 23/01 |

OTHER PUBLICATIONS

"International Application Serial No. PCT/US2013/067133, International Search Report dated Jul. 24, 2014", 3 pgs.
"International Application Serial No. PCT/US2013/067133, Written Opinion dated Jul. 24, 2014".

* cited by examiner

DOWNHOLE COMMUNICATION BETWEEN WELLBORES UTILIZING SWELLABLE MATERIALS

PRIORITY APPLICATIONS

This application is a U.S. National Stage Filing under 35 U.S.C. 371 from International Application No. PCT/US2013/067133, filed on 28 Oct. 2013, and published as WO 2015/065321 on 7 May 2015, which application and publication are incorporated herein by reference in their entirety.

TECHNICAL FIELD

This disclosure relates generally to equipment utilized and operations performed in conjunction with subterranean wellbores and, in one example described below, more particularly provides for downhole communication between wellbores utilizing swellable materials.

BACKGROUND

In some circumstances, an existing wellbore may become unusable, for example, due to structural issues (such as, casing collapse or parting, etc.) or fluid/pressure issues (such as, a blowout or poor cement integrity, etc.). However, a section of the wellbore may be salvageable for further production or injection use. Therefore, it will be appreciated that improvements are continually needed in the arts of constructing well systems and providing contingency measures in such circumstances. These improvements may be useful whether or not any section or all of an existing wellbore is considered usable.

DETAILED DESCRIPTION

Figure 1:
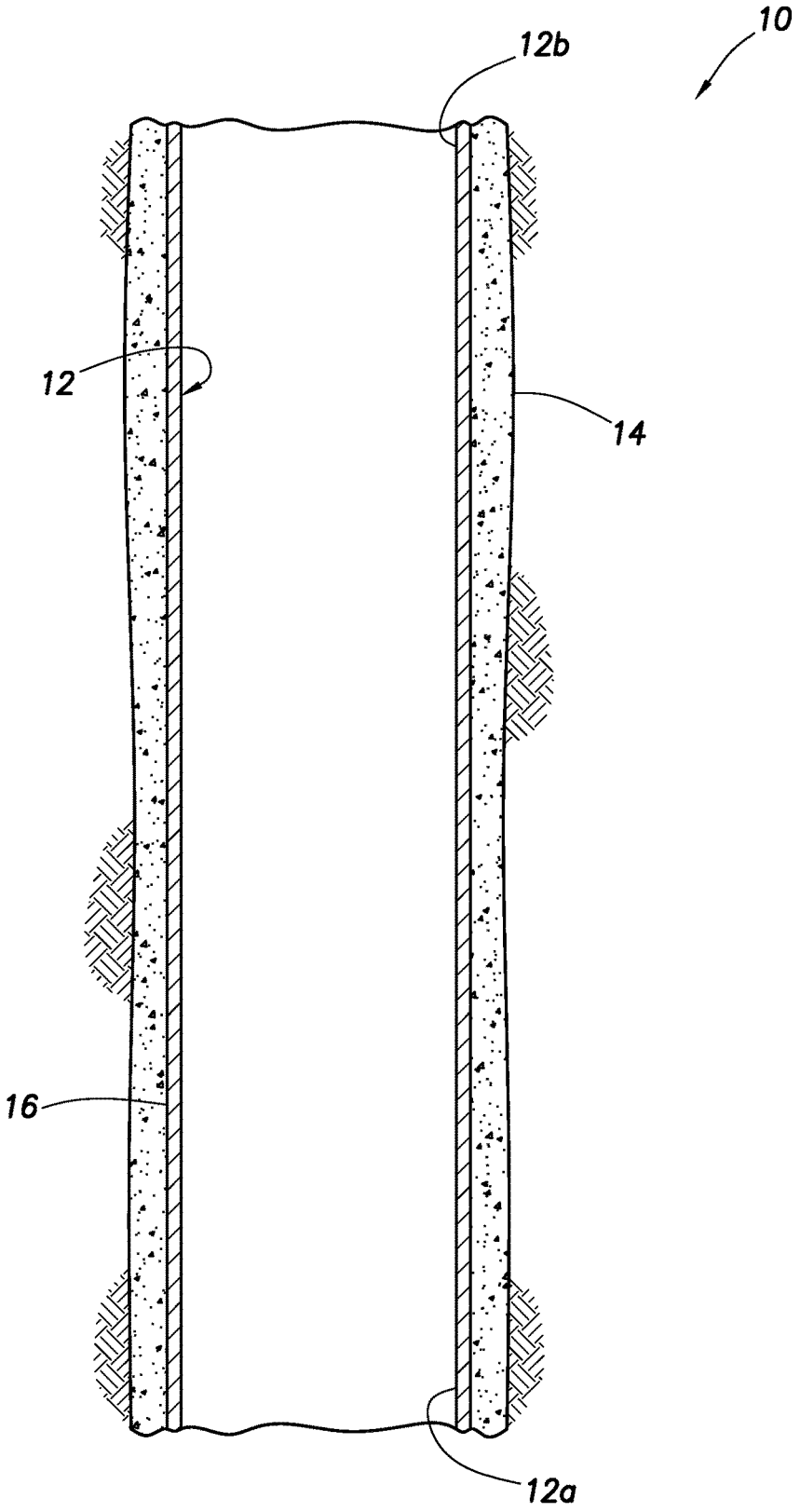
FIG. 1 is a representative cross-sectional view of a first stage of a well system and associated method which can embody principles of this disclosure.

Representatively illustrated in FIGS. 1-5 is a system 10 for use with a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In FIG. 1, a portion of an existing wellbore 12 is representatively illustrated. In this example, the existing wellbore 12 is generally vertical, and is lined with cement 14 and casing 16, but in other examples the method could be performed in an inclined, horizontal or otherwise non-vertical, uncased and/or uncemented interval of the wellbore. Thus, the scope of this disclosure is not limited to any of the details of the existing wellbore 12 depicted in the drawings or described herein.

It is desired in this example to establish communication with a lower section 12*a* of the existing wellbore 12. An upper section 12*b* of the existing wellbore 12 may, for example, have experienced issues such as casing collapse or erosion, a blowout, inter-zonal communication, etc. However, it should be understood that it is not necessary in keeping with the principles of this disclosure for any particular section of an existing wellbore to be "upper" or "lower" with respect to any other section, and it is not necessary for any section of an existing wellbore to have experienced any particular issue or problem.

Figure 2:
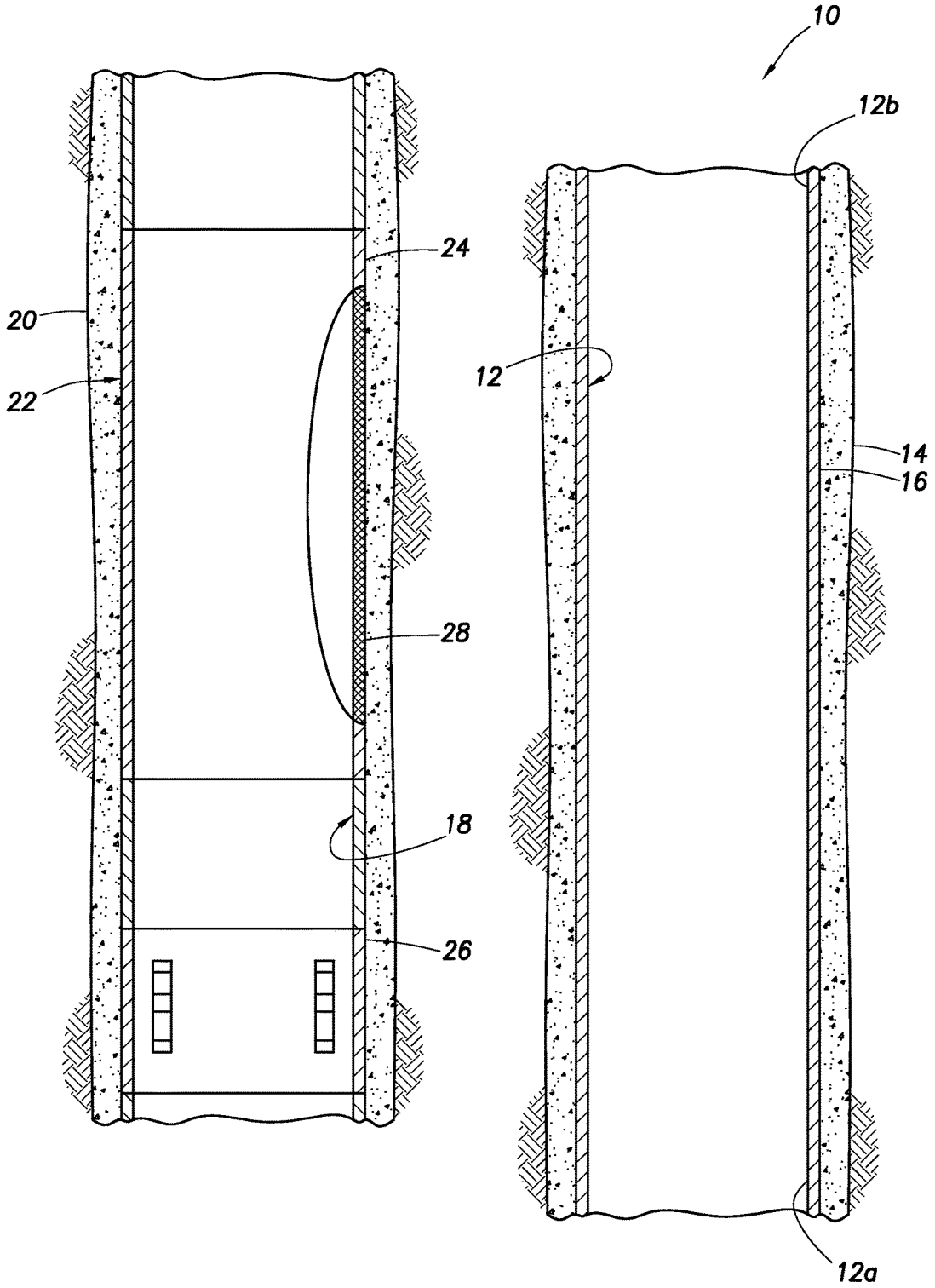
FIG. 2 is a representative cross-sectional view of the system and method, wherein a relief wellbore has been drilled and cased.

Referring additionally now to FIG. 2, a relief wellbore 18 has been drilled at least partially proximate the existing wellbore 12. A "relief wellbore" is used herein to refer to a wellbore drilled to establish downhole communication between the surface and a preexisting wellbore, typically (but not necessarily) to resolve a problem or issue experienced with the preexisting wellbore.

The relief wellbore 18 is depicted in FIG. 2 as being generally vertical and lined with cement 20 and casing 22, but in other examples the method could be performed in an inclined, horizontal or otherwise non-vertical, uncased and/or uncemented interval of the relief wellbore. Thus, the scope of this disclosure is not limited to any of the details of the relief wellbore 18 depicted in the drawings or described herein.

In FIG. 2, the existing wellbore 12 and the relief wellbore 18 appear to be parallel and disposed perhaps only a meter or less apart. However, in other examples the existing and relief wellbores 12, 18 may not be parallel to each other, and may be further apart.

Preferably, the wellbores 12, 18 are "proximate" one another, in that a connecting wellbore (not shown in FIG. 2, see FIG. 3) can conveniently be drilled between the wellbores. For example, the wellbores 12, 18 could be tens or hundreds of meters apart, but preferably are not a thousand or more meters apart.

In the FIG. 2 example, the casing 22 includes a preformed window joint 24 and an orienting latch receptacle 26. The window joint 24 provides a relatively easily milled- or drilled-through lateral window 28 for drilling through a side of the casing 22, and the orienting latch receptacle 26 provides for securing and orienting a whipstock or other diverter (not shown in FIG. 2, see FIG. 3) during the milling and/or drilling process.

However, it is not necessary in keeping with the principles of this disclosure for the casing 22 to include the window joint 24 and/or the orienting latch receptacle 26. It is possible, for example, to mill through a side of the casing 22 without use of the window joint 24, and to secure and orient a whipstock or diverter without use of the receptacle 26 (e.g., using a packer to secure the diverter, and a separate orienting tool to orient the diverter, etc.). Thus, the scope of this disclosure is not limited to use of any particular tools or techniques in performing the methods described herein.

A suitable window joint for use in the FIG. 2 system 10 is a LATCHRITE™ window joint, and a suitable orienting latch receptacle for use in the FIG. 2 system is a SPERRY LATCH COUPLING™, both marketed by Halliburton Energy Services, Inc. of Houston, Tex. USA. However, other window joints and orienting latch receptacles may be used in keeping with the principles of this disclosure.

Figure 3:
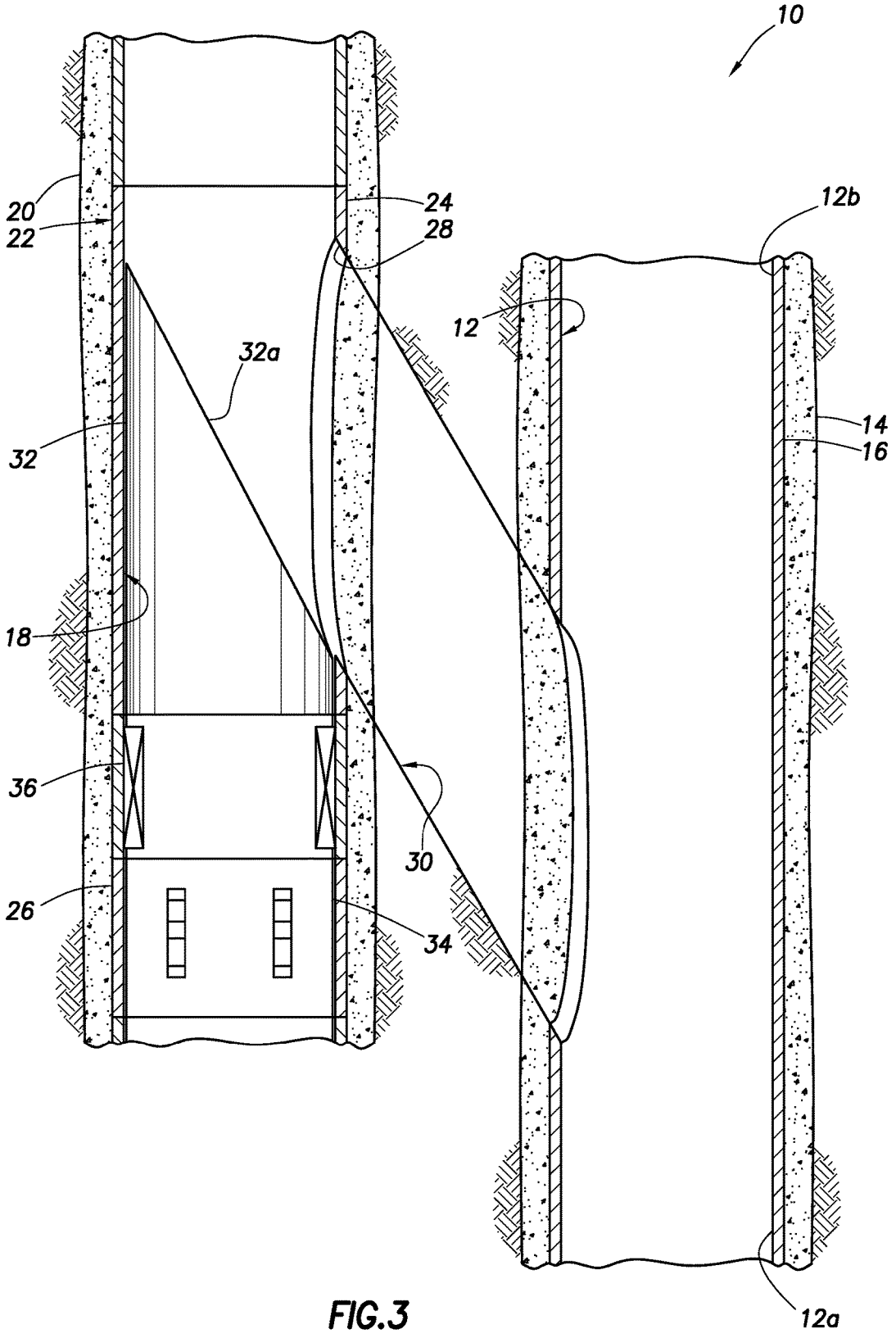
FIG. 3 is a representative partially cross-sectional view of the system and method, wherein a connecting wellbore has been drilled.

Referring additionally now to FIG. 3, the system 10 is depicted after a connecting wellbore 30 has been drilled from the relief wellbore 18 to the existing wellbore 12. The connecting wellbore 30 provides for communication between the relief wellbore 18 and the section 12*a* of the existing wellbore 12 as described more fully below.

For drilling the connecting wellbore 30, a whipstock or diverter 32 is positioned in the relief wellbore 18 to laterally deflect various mills and/or drills (not shown), so that the window 28 is opened and the connecting wellbore is drilled to intersect the existing wellbore 12. An orienting latch 34 azimuthally orients an inclined deflecting face 32*a* of the diverter 32, so that it faces toward the window 28 (or at least in a direction of the existing wellbore 12, for example, if the window is not pre-milled in the casing 22).

The orienting latch 34 can also secure the diverter 32 relative to the casing 22. A packer or other annular seal 36 can be used to prevent milling and/or drilling debris from fouling the latch 34 or accumulating in the relief wellbore 18.

The same diverter 32, latch 34 and annular seal 36 may be used for all stages of a milling and/or drilling operation, and for deflecting one or more tubular strings (not shown in FIG. 3, see FIGS. 4 & 5) from the relief wellbore 18 into the connecting wellbore 30. In other examples, separate specialized diverters, latches and/or seals may be used for different stages or for different operations.

Figure 4:
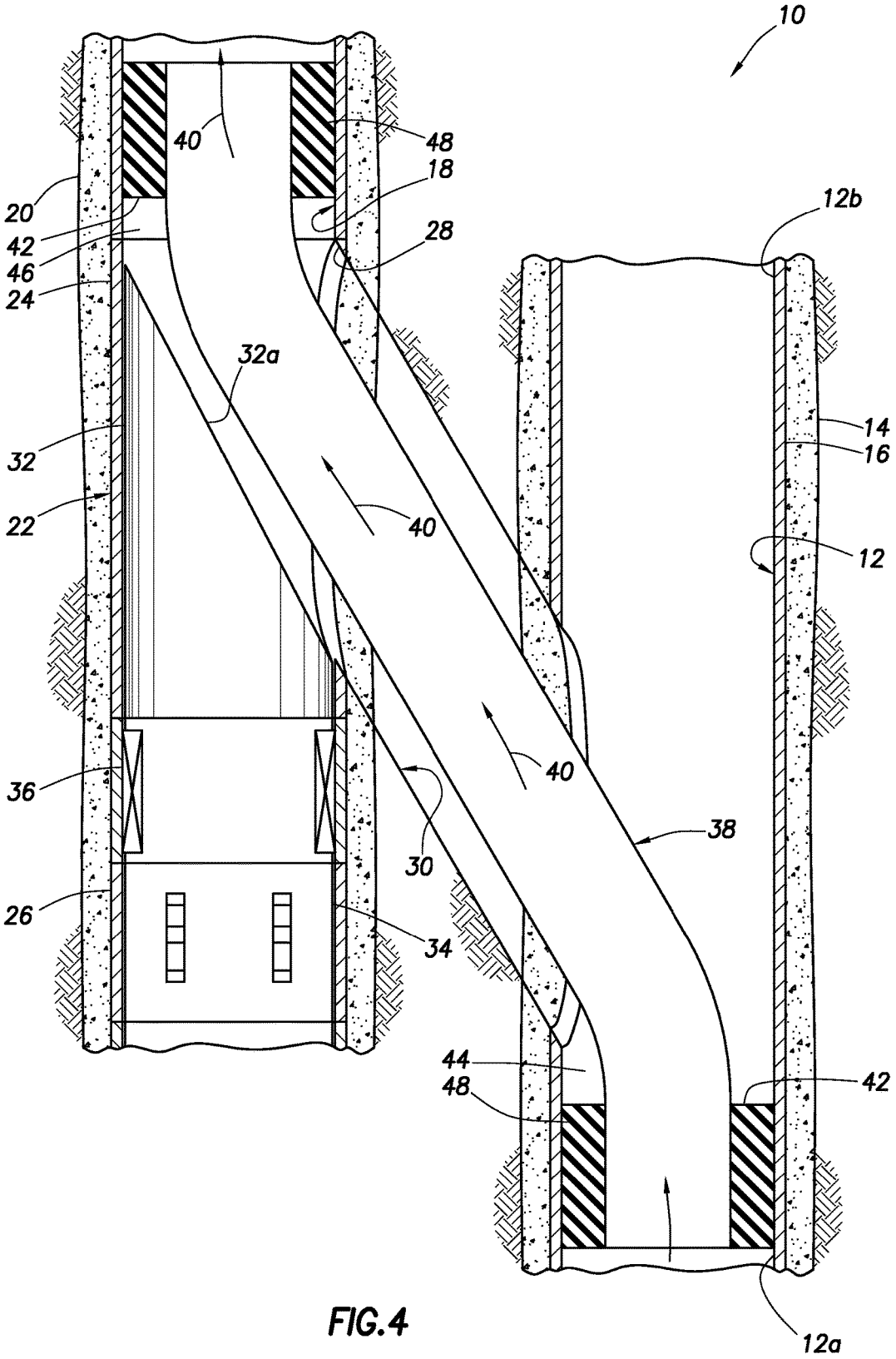
FIG. 4 is a representative partially cross-sectional view of the system and method, wherein a tubular string has been installed through the connecting wellbore.

Referring additionally now to FIG. 4, the system 10 is representatively illustrated after a tubular string 38 has been installed in the existing, relief and connecting wellbores 12, 18, 30. In this example, the tubular string 38 can be installed by deflecting a lower end laterally off of the inclined face 32*a* of the diverter 32, from the relief wellbore 18 into the connecting wellbore 30, and thence from the connecting wellbore into the existing wellbore 12.

In some examples, the diverter 32 may not be present in the relief wellbore 18 when the tubular string 38 is installed. For example, the diverter 32 may have been retrieved after the connecting wellbore 30 was drilled, or the diverter 32 may not have been used to drill the connecting wellbore, etc. If the diverter 32 is not used to deflect the tubular string 38 into the connecting wellbore 30, the tubular string may be otherwise directed into the connecting wellbore, for example, by use of a bent joint or a biasing device (not shown) connected at a lower end of the tubular string.

The tubular string 38 provides for fluid communication between the existing wellbore 12 and the relief wellbore 18, for example, for production of fluid 40 from the section 12*a* of the existing wellbore and into the relief wellbore, and then to the earth's surface. If, however, the existing wellbore 12 is used for injection purposes (such as, in water or steam flooding operations, for disposal, etc.), the fluid 40 could flow in an opposite direction. Thus, the scope of this disclosure is not limited to any particular direction, origin or destination of fluid flow.

In the FIG. 4 example, an annular seal 42 is positioned at each end of the tubular string 38. One each of the annular seals 42 is positioned in the existing wellbore 12 and in the relief wellbore 18. The annular seal 42 in the existing wellbore 12 seals off an annulus 44 formed radially between the tubular string 38 and the existing wellbore, and the annular seal in the relief wellbore 18 seals off an annulus 46 formed radially between the tubular string and the relief wellbore.

Although only a single annular seal 42 is depicted in each of the existing and relief wellbores 12, 18, it should be understood that any number of annular seals may be used. In addition, it is not necessary for the annular seals 42 to be of the same configuration or construction, or for the annular seals to be positioned at ends of the tubular string 38. Thus, the scope of this disclosure is not limited to any particular number, size, construction, configuration, position or other details of the annular seals 42.

In this example, the annular seals 42 preferably include a swellable material 48 that swells downhole, at least after the tubular string 38 has been appropriately installed, in order to secure and seal the tubular string in the existing and relief wellbores 18. In this manner, the annuli 44, 46 can be effectively sealed off, thereby providing for sealed communication between the relief wellbore 18 and the section 12*a* of the existing wellbore.

Preferably, the swellable material 48 swells when it is contacted with a particular activating agent (e.g., oil, gas, other hydrocarbons, water, acid, other chemicals, etc.) in the well. The activating agent may already be present in the well, or it may be introduced after installation of the tubular string 38 in the well, or it may be carried into the well with the tubular string, etc. The swellable material 48 could instead swell in response to exposure to a particular temperature, or upon passage of a period of time, or in response to another stimulus, etc.

Thus, it will be appreciated that a wide variety of different ways of swelling the swellable material 48 exist and are known to those skilled in the art. Accordingly, the scope of this disclosure is not limited to any particular manner of swelling the swellable material 48. Furthermore, the scope of this disclosure is also not limited to any of the details of the well system 10 and method described herein, since the principles of this disclosure can be applied to many different circumstances.

The term "swell" and similar terms (such as "swellable") are used herein to indicate an increase in volume of a swellable material. Typically, this increase in volume is due to incorporation of molecular components of the activating agent into the swellable material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The activating agent which causes swelling of the swellable material 48 is in this example preferably a hydrocarbon fluid (such as oil or gas). In the well system 10, the swellable material 48 can swell when the fluid 40 comprises the activating agent (e.g., when the fluid enters the existing wellbore 12 from a formation surrounding the wellbore, when the fluid is circulated to the tubular string 38 from the surface, when the fluid is released from a chamber carried with the tubular string, etc.). In response, the annular seals 42 swell and seal off the annuli 44, 46.

The activating agent which causes swelling of the swellable material 48 could be comprised in any type of fluid. The activating agent could be naturally present in the well, or it could be conveyed with the annular seals 42, conveyed separately or flowed into contact with the swellable material 48 in the well when desired. Any manner of contacting the activating agent with the swellable material 48 may be used in keeping with the principles of this disclosure.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367, 7,059,415 and 7,143,832, the entire disclosures of which are incorporated herein by this reference.

As another alternative, the swellable material 48 may have a substantial portion of cavities therein which are compressed or collapsed at the surface condition. Then, after being placed in the well at a higher pressure, the material 48 is expanded by the cavities filling with fluid.

This type of apparatus and method might be used where it is desired to swell the swellable material 48 in the presence of gas rather than oil or water. A suitable swellable material is described in U.S. Published Application No. 2007-0257405, the entire disclosure of which is incorporated herein by this reference.

Preferably, the swellable material 48 used in the annular seals 42 swells by diffusion of hydrocarbons into the swellable material, or in the case of a water swellable material, by the water being absorbed by a super-absorbent material (such as cellulose, clay, etc.) and/or through osmotic activity with a salt-like material. Hydrocarbon-, water- and gas-swellable materials may be combined, if desired.

It should, thus, be clearly understood that any swellable material which swells when contacted by a predetermined activating agent may be used in keeping with the principles of this disclosure. The swellable material 48 could also swell in response to contact with any of multiple activating agents. For example, the swellable material 48 could swell when contacted by hydrocarbon fluid, or when contacted by water.

The swellable material 48 may itself seal off the annuli 44, 46. In other examples, the swellable material 48 may displace a seal or sealing layer into contact with the wellbores 12, 18 when the swellable material swells. Thus, the scope of this disclosure is not limited to any particular mechanism for sealing off the annuli 44, 46 in response to swelling of the swellable material 48.

Although the annular seals 42 are depicted in FIG. 4 as including the same swellable material 48, in other examples different swellable materials or multiple swellable materials may be used in the annular seals. For example, the annular seal 42 which is deflected from the relief wellbore 18 into the connecting wellbore 30, and then into the existing wellbore 12 may include a harder or otherwise more durable or abrasion resistant material as compared to the annular seal that remains in the relief wellbore.

Note that the annular seal 42 that seals off the annulus 44 in the existing wellbore 12 also performs a function of isolating the lower section 12*a* from the upper section 12*b* of the wellbore. In this manner, any issues or problems experienced in the upper section 12*b* will not affect a controlled flow of the fluid 40 between the existing and relief wellbores 12, 18.

In addition, note that, by sealing off the annuli 44, 46 on either side of the connecting wellbore 30, the connecting wellbore is isolated from the lower section 12*a* of the existing wellbore 12 (from which the fluid 40 is produced, or into which the fluid is injected), and is isolated from the relief wellbore 18 above the annular seal 42. In this manner, the uncased connecting wellbore 30 does not communicate with these other sections of the well. However, the connecting wellbore 30 could be cased, if desired, in other examples.

Figure 5:
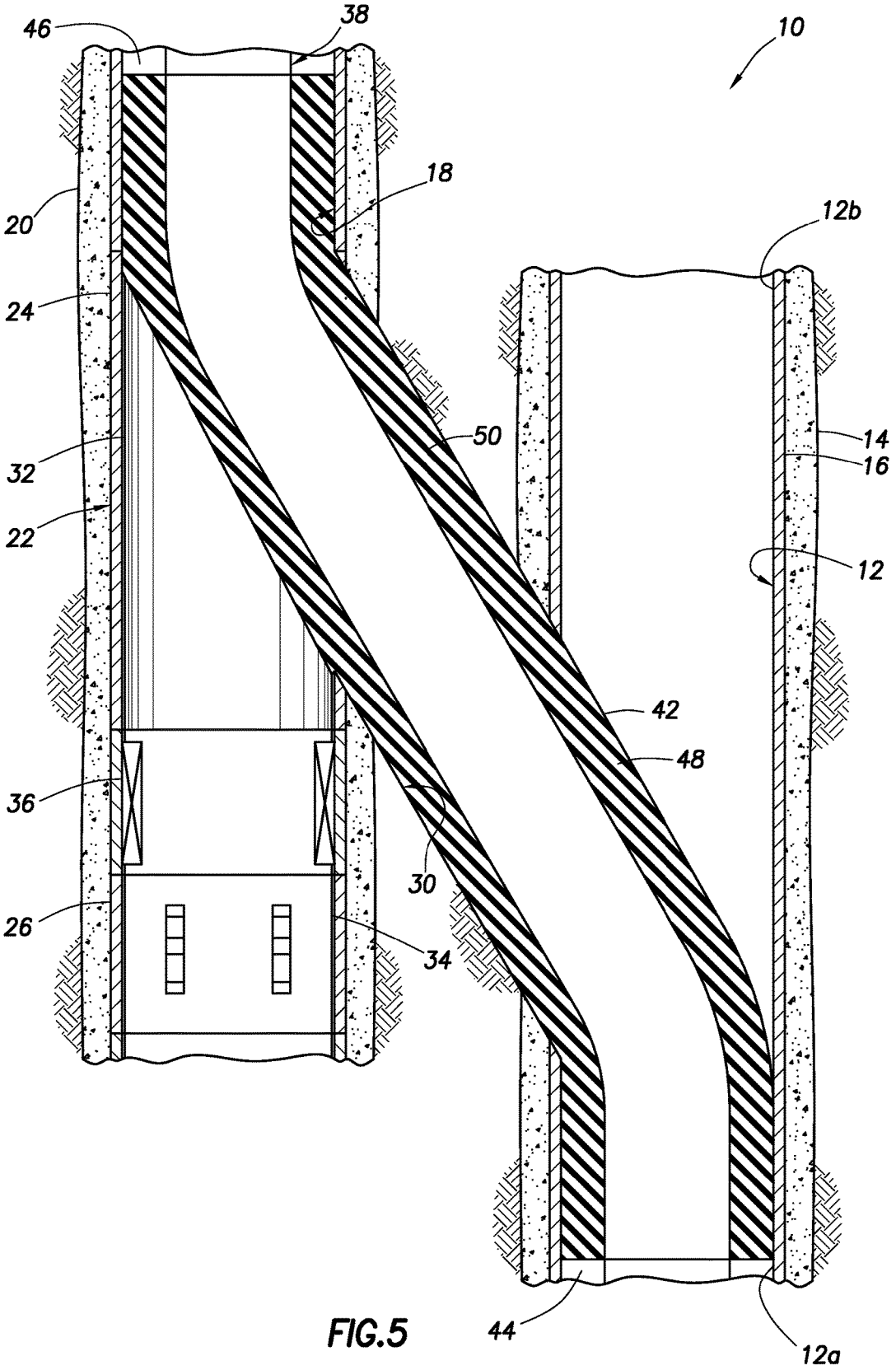
FIG. 5 is a representative partially cross-sectional view of the system and method, wherein another example of the tubular string has been installed through the connecting wellbore.

Referring additionally now to FIG. 5, another example of the system 10 and method is representatively illustrated. In this example, separate annular seals 42 at opposite ends of the tubular string 38 are not used. Instead, a single annular seal 42 extends through the connecting wellbore 30 and into each of the existing and relief wellbores 12, 18.

In the connecting wellbore 30, the annular seal 42 seals off an annulus 50 formed radially between the tubular string 38 and the connecting wellbore. In this manner, the annular seal 42 can provide for a completely sealed junction between the existing and connecting wellbores 12, 30, and between the relief and connecting wellbores 18, 30.

The tubular string 38 extends downwardly in the existing wellbore 12 beyond the annular seal 42, and extends upwardly in the relief wellbore 18 beyond the annular seal. Thus, the annular seal 42 is not necessarily positioned at any particular end of the tubular string 38.

The tubular string 38 extending upwardly or downwardly beyond the annular seal 42 can, for example, provide space for use of tongs and/or slips on a rig at the surface. Additional or alternative spaces for tongs and/or slips may be provided along a length of the annular seal 42, if desired.

Although the annular seal 42 is depicted in FIG. 5 as being a single element, multiple annular seals may be provided. The multiple annular seals 42 could be positioned adjacent one another or spaced apart (for example, to provide appropriate spaces for use of tongs and/or slips, or so that different annular seals seal off the respective annuli 44, 46, 50, etc.). Thus, the scope of this disclosure is not limited to any particular number, spacing, configuration or other details of the annular seal 42.

It may now be fully appreciated that the above disclosure provides significant advancements to the arts of constructing well systems and providing contingency measures in various circumstances. In examples described above, the swellable annular seal(s) 42 can be used with the tubular string 38 to provide for sealed fluid communication between the existing and relief wellbores 12, 18 via a connecting wellbore 30, which connects the existing and relief wellbores.

A method of connecting to an existing wellbore 12 downhole is provided to the art by the above disclosure. In one example, the method comprises: installing a swellable material 48 into the existing wellbore 12 from a connecting wellbore 30 drilled into the existing wellbore 12.

The method can include drilling the connecting wellbore 30 from a relief wellbore 18 drilled proximate the existing wellbore 12.

The method can include the swellable material 48 swelling in the existing wellbore 12.

The installing step can comprise inserting a tubular string 38 from a relief wellbore 18 through the connecting wellbore 30 and into the existing wellbore 12. Swelling of the swellable material 48 may seal off an annulus 44 formed between the tubular string 38 and the existing wellbore 12.

Swelling of the swellable material 48 may seal off an annulus 50 formed between the tubular string 38 and the connecting wellbore 30. Swelling of the swellable material 48 may seal off an annulus 46 formed between the tubular string 38 and the relief wellbore 18.

The method can include drilling a relief wellbore 18 proximate the existing wellbore 12, and then drilling the connecting wellbore 30 from the relief wellbore 18 to the existing wellbore 12. The installing step may be performed after drilling the connecting wellbore 30.

A well system 10 is also described above. In one example, the well system 10 can include a relief wellbore 18 drilled proximate an existing wellbore 12; a connecting wellbore 30 drilled from the relief wellbore 18 to the existing wellbore 12; a tubular string 38 extending from the relief wellbore 18 through the connecting wellbore 30 and into the existing wellbore 12; and a swellable material 48 which swells in an annulus (44, 46 and/or 50) formed between the tubular string 38 and at least one of the group comprising the relief wellbore 18, the connecting wellbore 30 and the existing wellbore 12.

The swellable material 48 may swell in response to contact with a fluid (such as fluid 40) downhole. The swellable material 48 may swell in each of the relief wellbore 18, the connecting wellbore 30 and the existing wellbore 12.

A fluid 40 can flow between the existing wellbore 12 and the relief wellbore 18 via the tubular string 38.

The swellable material 48 may isolate sections 12*a,b* of the existing wellbore 12 from each other.

The swellable material 48 may swell in the annuli 44, 46 between the tubular string 38 and each of the relief wellbore 18 and the existing wellbore 12. The swellable material 48 may swell in the annulus 50 between the tubular string 38 and the connecting wellbore 30.

Another method of connecting to an existing wellbore 12 downhole can comprise: drilling a relief wellbore 18 proximate the existing wellbore 12; then drilling a connecting wellbore 30 from the relief wellbore 18 to the existing wellbore 12; and then installing a swellable material 48 into the existing wellbore 12 from the connecting wellbore 30.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of connecting to an existing wellbore connected to a formation downhole, the method comprising installing a swellable material into the existing wellbore from a connecting wellbore drilled into the existing wellbore such that a flow path for fluid from the formation, then through the existing wellbore, and then to the connecting wellbore is established.

2. The method of claim 1, further comprising drilling the connecting wellbore from a relief wellbore drilled proximate the existing wellbore.

3. The method of claim 1, further comprising the swellable material swelling in the existing wellbore.

4. The method of claim 1, wherein the installing further comprises inserting a tubular string from a relief wellbore through the connecting wellbore and into the existing wellbore, and wherein swelling of the swellable material seals off an annulus formed between the tubular string and the existing wellbore.

5. The method of claim 4, wherein swelling of the swellable material seals off an annulus formed between the tubular string and the connecting wellbore.

6. The method of claim 4, wherein swelling of the swellable material seals off an annulus formed between the tubular string and the relief wellbore.

7. The method of claim 1, further comprising drilling a relief wellbore proximate the existing wellbore, and then drilling the connecting wellbore from the relief wellbore to the existing wellbore, wherein the installing is performed after drilling the connecting wellbore.

8. A well system for production of a formation fluid, comprising:

a formation;

a relief wellbore drilled proximate an existing wellbore connected to the formation;

a connecting wellbore drilled from the relief wellbore to the existing wellbore, such that fluid from the formation is flowable to the existing wellbore, through the connecting wellbore, and into the relief wellbore;

a tubular string extending from the relief wellbore through the connecting wellbore and into the existing wellbore; and a swellable material which is swellable in an annulus formed between the tubular string and at least one of the relief wellbore, the connecting wellbore or the existing wellbore.

9. The well system of claim 8, wherein the swellable material is swellable in response to contact with a fluid downhole.

10. The well system of claim 8, wherein the swellable material is swellable in each of the relief wellbore, the connecting wellbore and the existing wellbore.

11. The well system of claim 8, wherein fluid is flowable between the existing wellbore and the relief wellbore via the tubular string.

12. The well system of claim 8, wherein the swellable material is swellable to isolate sections of the existing wellbore from each other.

13. The well system of claim 8, wherein the swellable material is swellable in the annulus between the tubular string and each of the relief wellbore and the existing wellbore.

14. The well system of claim 8, wherein the swellable material is swellable in the annulus between the tubular string and the connecting wellbore.

15. A method of connecting to an existing wellbore connected to a formation downhole, the method comprising:

drilling a relief wellbore proximate the existing wellbore;

drilling a connecting wellbore from the relief wellbore to the existing wellbore; and installing a swellable material into the existing wellbore from the connecting wellbore such that a flow path for fluid from the formation, then through the existing wellbore, and then to the connecting wellbore is established.

16. The method of claim 15, further comprising the swellable material swelling in the existing wellbore.

17. The method of claim 15, wherein the installing further comprises inserting a tubular string from the relief wellbore through the connecting wellbore and into the existing wellbore, and wherein swelling of the swellable material seals off an annulus formed between the tubular string and the existing wellbore.

18. The method of claim 15, wherein swelling of the swellable material seals off an annulus formed between a tubular string and the connecting wellbore.

19. The method of claim 15, wherein swelling of the swellable material seals off an annulus formed between a tubular string and the relief wellbore.

20. The method of claim 15, wherein swelling of the swellable material isolates sections of the existing wellbore from each other.

* * * * *